US006951316B1

(12) United States Patent
Heidelberger

(10) Patent No.: US 6,951,316 B1
(45) Date of Patent: Oct. 4, 2005

(54) TOWABLE DISPENSER SYSTEM

(76) Inventor: Tye Heidelberger, 208 1st St., P.O. Box 141, Chester, SD (US) 57016

( * ) Notice: Subject to any disclaimer, the term of this patent is extended or adjusted under 35 U.S.C. 154(b) by 0 days.

(21) Appl. No.: 10/238,070

(22) Filed: Sep. 9, 2002

(51) Int. Cl.[7] ..... B65H 16/02

(52) U.S. Cl. ..... 242/557; 242/403; 242/594.4; 242/594.6; 242/598.1

(58) Field of Search ..... 242/557, 594.3, 242/594.6, 594, 594.4, 598.1, 403

(56) References Cited

U.S. PATENT DOCUMENTS

| | | | | | |
|---|---|---|---|---|---|
| 420,800 | A | * | 2/1890 | Huckins | 140/118 |
| 809,721 | A | * | 1/1906 | Myers | 242/423.1 |
| 2,664,253 | A | | 12/1953 | Therrien | |
| 3,722,861 | A | | 3/1973 | Anderson | |
| 3,937,413 | A | * | 2/1976 | Devine | 242/557 |
| 3,990,650 | A | * | 11/1976 | Devine | 242/422.4 |
| 4,585,130 | A | * | 4/1986 | Brennan | 211/190 |
| 5,042,737 | A | * | 8/1991 | Sigle et al. | 242/423.1 |
| D326,807 | S | | 6/1992 | Hargrove | |
| 5,316,232 | A | * | 5/1994 | Lambert, Jr. | 242/422.4 |
| 5,568,900 | A | * | 10/1996 | Conroy | 242/557 |
| 5,582,216 | A | * | 12/1996 | Smith et al. | 140/107 |
| 5,667,163 | A | | 9/1997 | Sordahl | |
| D424,774 | S | | 5/2000 | Zarley | |
| 6,079,663 | A | | 6/2000 | Slater | |
| 6,116,533 | A | * | 9/2000 | Elder | 242/594.4 |
| 6,193,218 | B1 | | 2/2001 | Philyaw | |
| 6,270,094 | B1 | * | 8/2001 | Campbell | 280/47.19 |
| 6,419,182 | B1 | | 7/2002 | Jansky | |
| 6,422,504 | B1 | * | 7/2002 | Elder | 242/594.6 |

OTHER PUBLICATIONS http://www.quadivator.com/accessories/bwd.htm, dated Sep. 3, 2002, 2 pages.

* cited by examiner

*Primary Examiner*—William A. Rivera
*Assistant Examiner*—Sang Kim
(74) *Attorney, Agent, or Firm*—Jeffrey A. Proehl; Leonard & Proehl, Prof. LLC

(57) ABSTRACT

A towable dispenser system for providing a highly portable and convenient means of dispensing elongate flexible materials such as wire. The system includes a frame removably attachable to a vehicle for pulling the frame, ground engaging apparatus for engaging a ground surface and supporting the frame above the ground surface, and a spool mounting assembly mounted on the frame for supporting at least one spool on the frame. The spool mounting assembly comprises a primary support member mounted on the frame, a spool axle being mounted on the primary support member for positioning in the bore of a spool. The spool mounting assembly includes at least one, and possibly two, spool retaining assemblies for releasably retaining spools on the spool axle. The spool retaining assembly may include a retaining arm movable between an engaged position blocking spool movement off of the spool axle and a disengaged position permitting spool movement off of the spool axle.

15 Claims, 5 Drawing Sheets

TOWABLE DISPENSER SYSTEM

BACKGROUND OF THE INVENTION

1. Field of the Invention

The present invention relates to dispenser apparatus and more particularly pertains to a new towable dispenser system for providing a highly portable and convenient means of dispensing elongate flexible materials such as wire.

2. Description of the Prior Art

The use of dispenser apparatus, especially those adapted to dispense wire, is known in the prior art. More specifically, dispenser apparatus for wire, and particularly barbed wire, that have been heretofore devised and utilized tend to be devices that are manually carried or manually pulled across the ground. Some known devices are carried on a movable transport and dispense a single strand of wire, but are either ill suited to the faster pace and greater strains that accompany the faster pace of movement and dispensing possible with the movable transport, including strains that may dislodge the spool holding the wire from the transport. Attempts to meet the greater strains of the faster pace of movement appear to have resulted in the development of devices that are less convenient and more time consuming to use, which hinders and may counteract the faster pace of dispensing of wire possible when using the movable transport.

In these respects, the towable dispenser system according to the present invention substantially departs from the conventional concepts and designs of the prior art, and in so doing provides an apparatus primarily developed for the purpose of providing a highly portable and convenient means of dispensing elongate flexible materials such as wire.

SUMMARY OF THE INVENTION

In view of the foregoing disadvantages inherent in the known types of dispenser apparatus now present in the prior art, the present invention provides a new towable dispenser system construction wherein the same can be utilized for providing a highly portable and convenient means of dispensing elongate flexible materials such as wire.

To attain this, the present invention generally comprises a frame removably attachable to a vehicle for pulling the frame behind the vehicle, ground engaging apparatus for engaging a ground surface and supporting the frame above the ground surface, and a spool mounting assembly mounted on the frame for supporting at least one spool on the frame. The spool mounting assembly comprises a primary support member mounted on the frame, a spool axle being mounted on the primary support member for positioning in the bore of a spool. The spool mounting assembly includes at least one, and possibly two, spool retaining assemblies for releasably retaining spools on the spool axle. The spool retaining assembly may include a retaining arm movable between an engaged position blocking spool movement off of the spool axle and a disengaged position permitting spool movement off of the spool axle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to more quickly install multiple strands of fencing wire simultaneously, and to quickly and easily replace spools on the invention during the fencing process.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
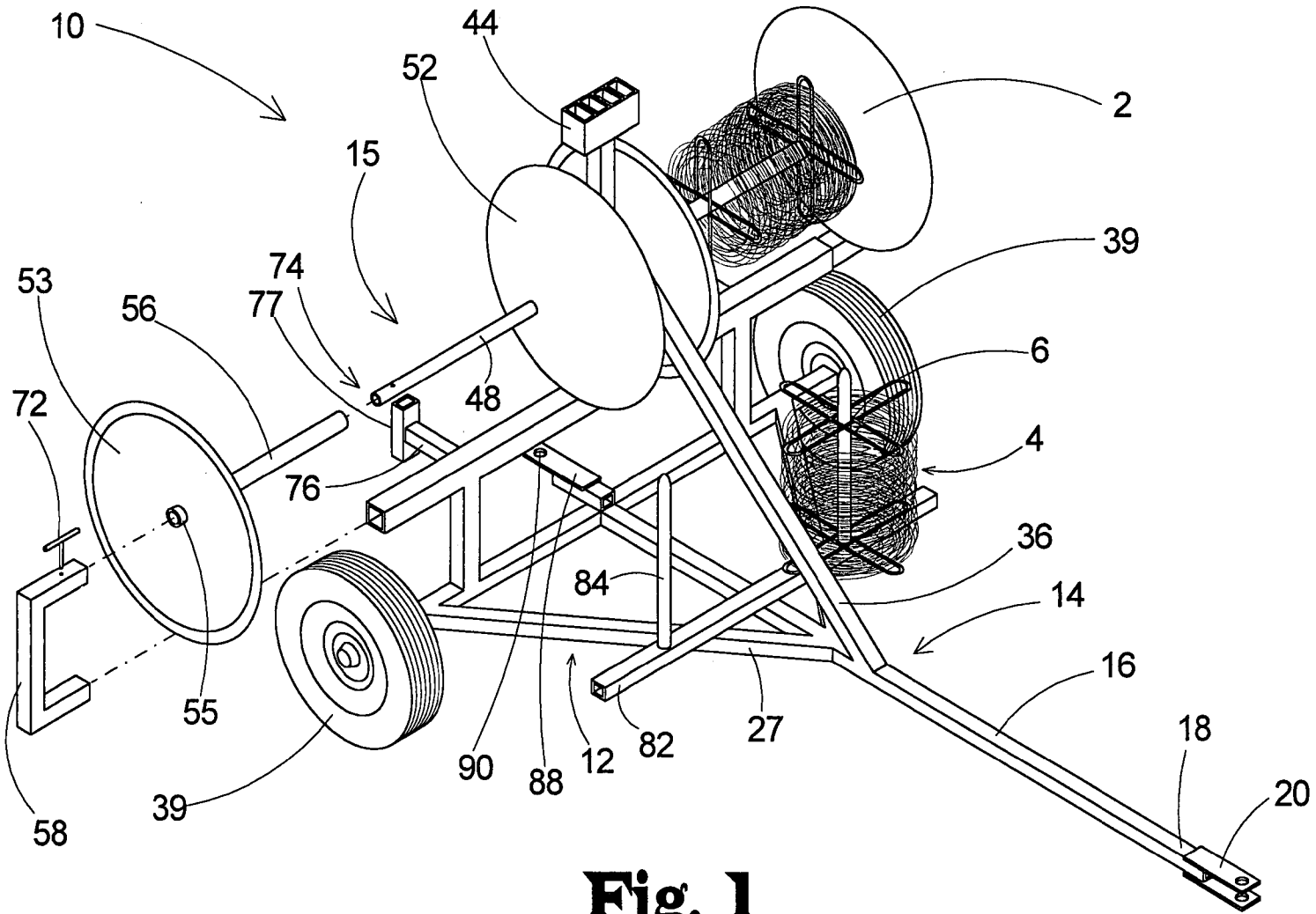
FIG. 1 is a schematic front perspective view of a new towable dispenser system according to the present invention.
Figure 2:
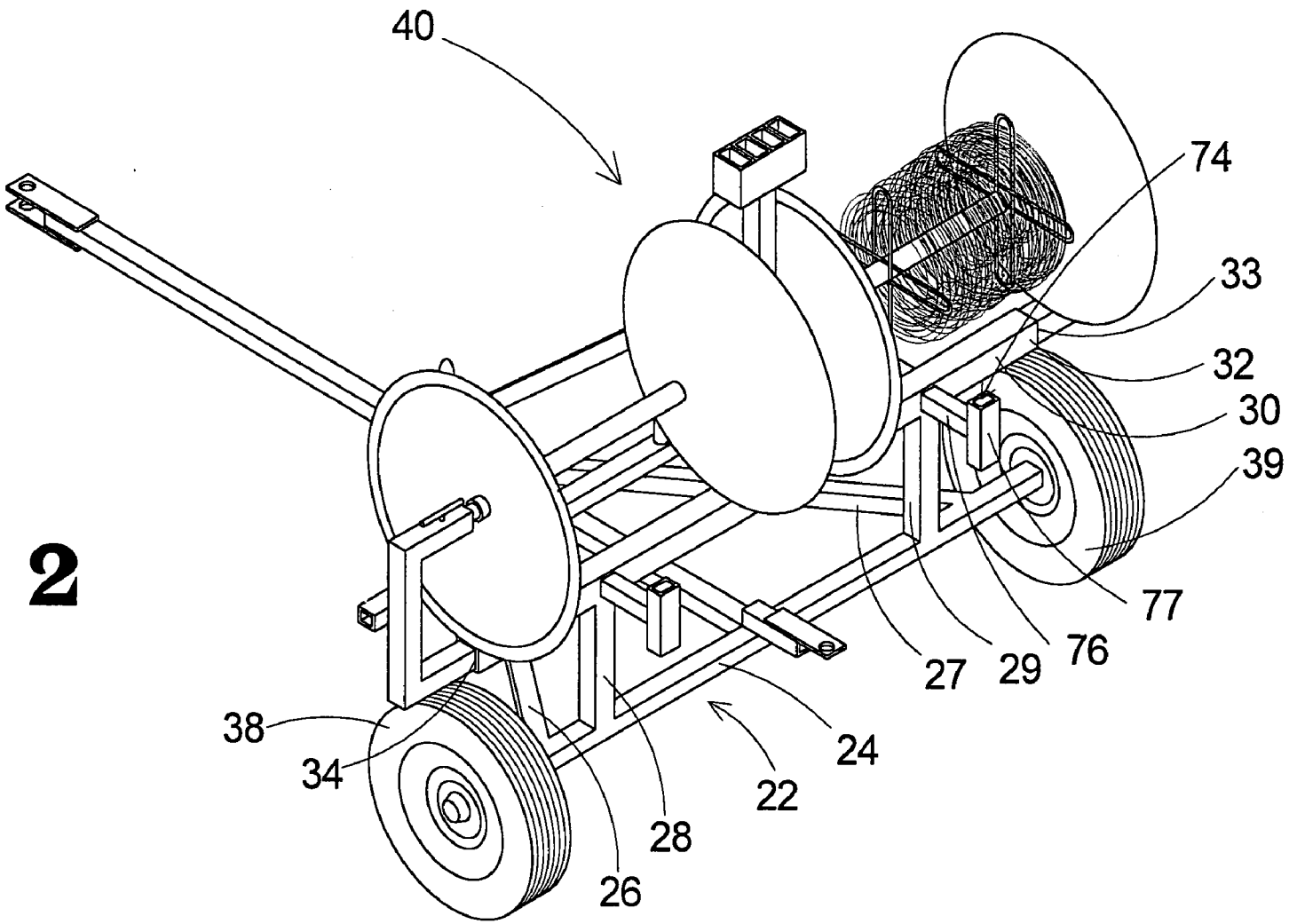
FIG. 2 is a schematic rear perspective view of the present invention.
Figure 3:
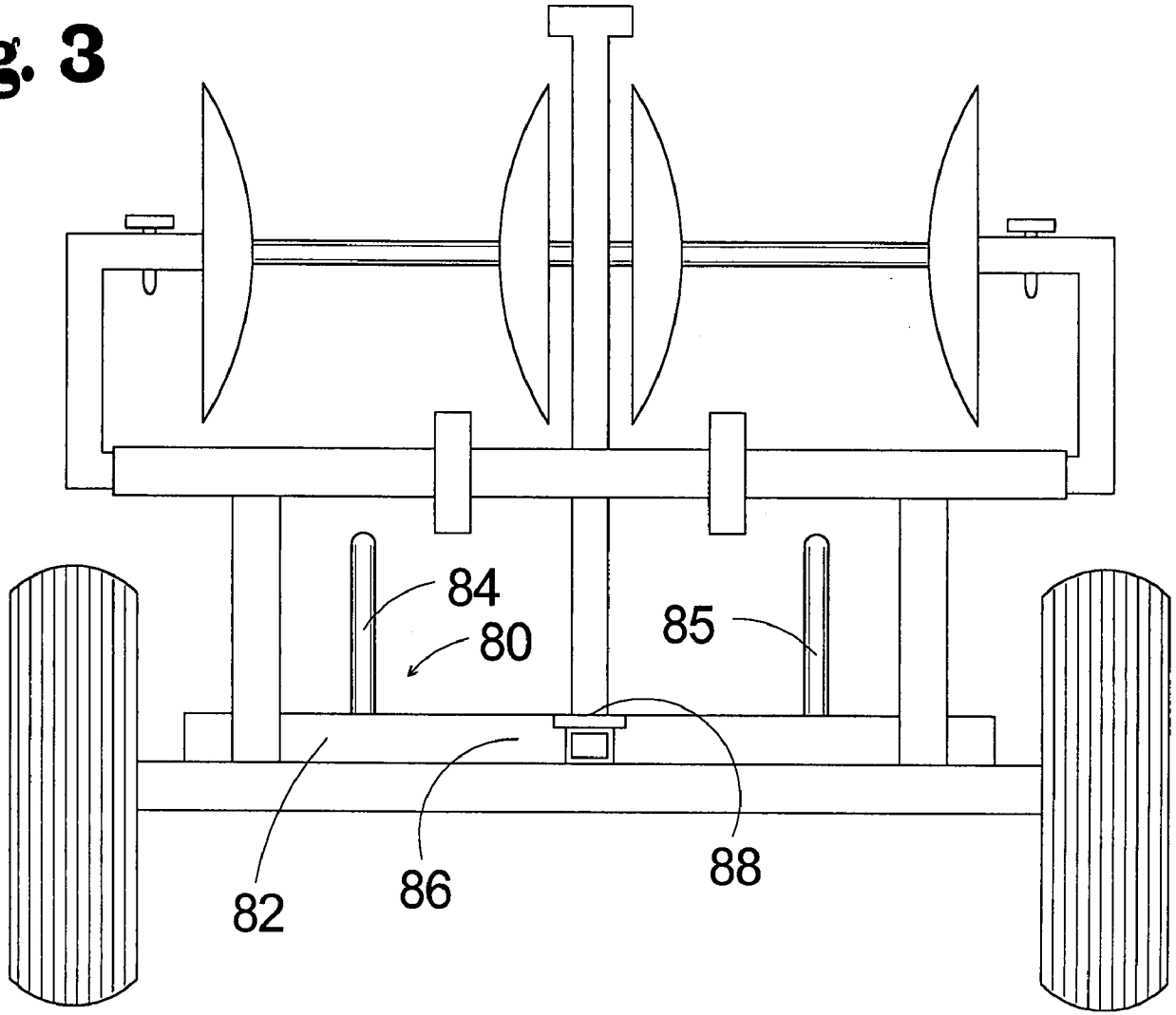
FIG. 3 is a schematic rear elevation view of the present invention.
Figure 4:
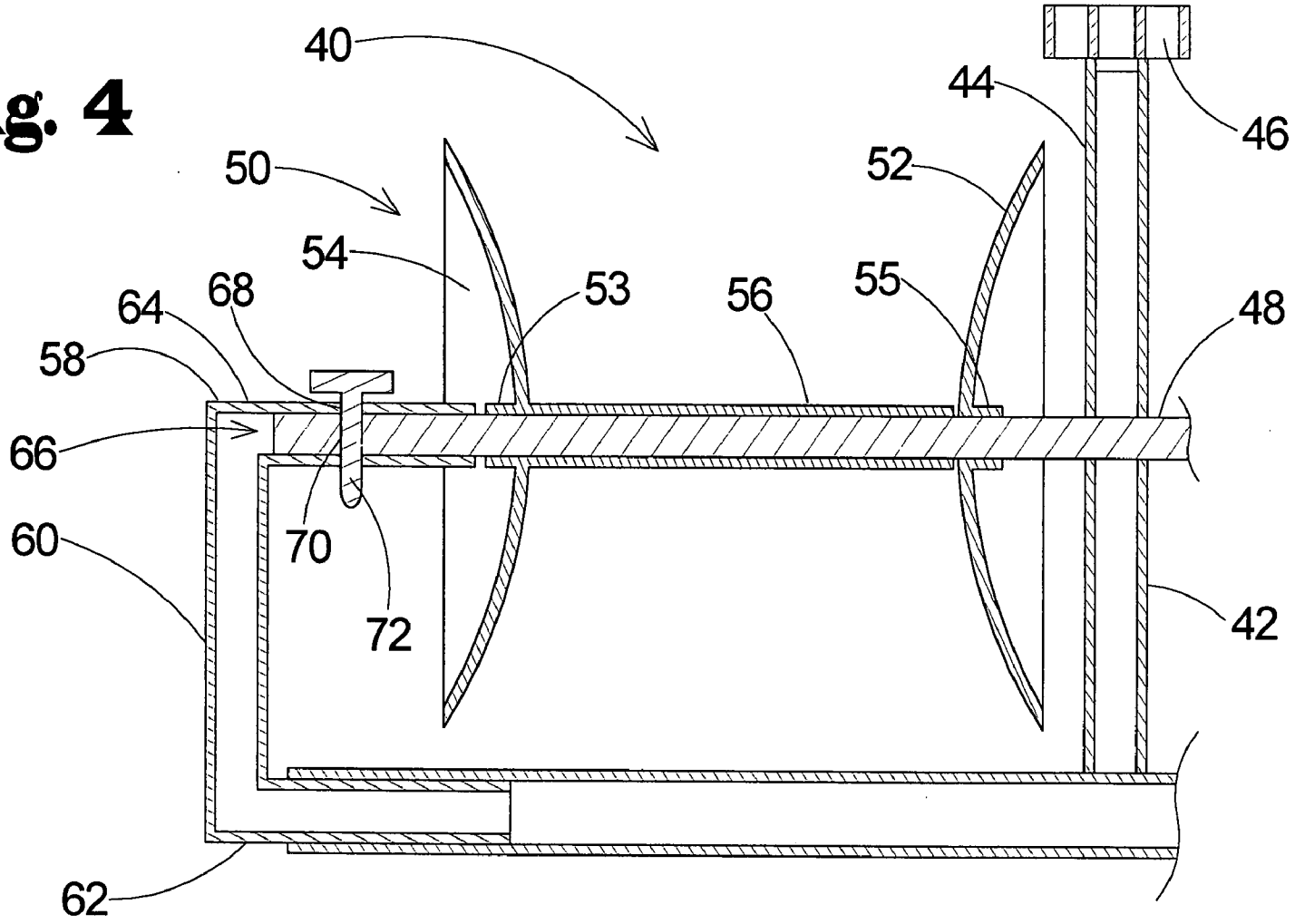
FIG. 4 is a schematic sectional view of the present invention.
Figure 5:
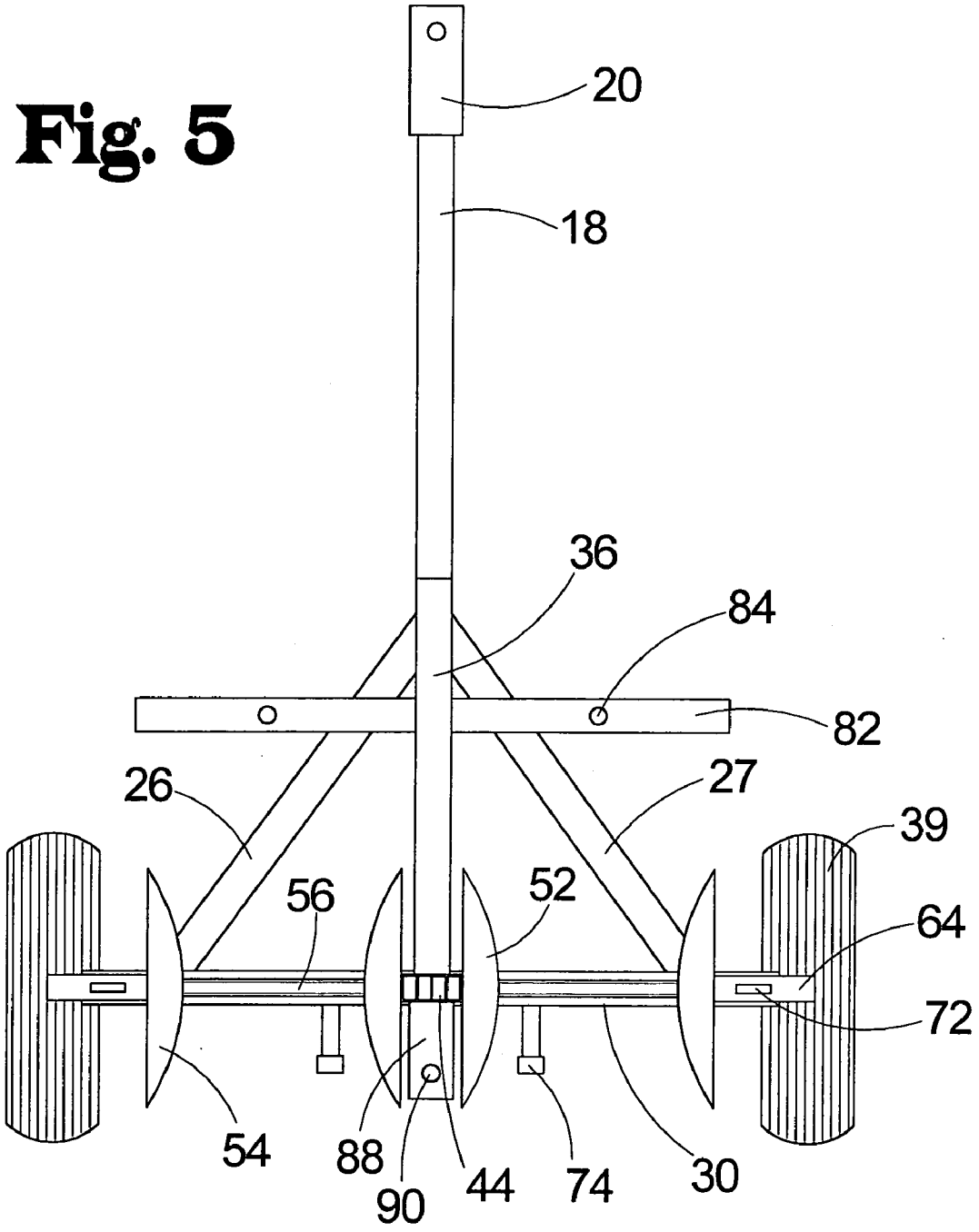
FIG. 5 is a schematic top plan view of the present invention.

With reference now to the drawings, and in particular to FIGS. 1 through 5 thereof, a new towable dispenser system embodying the principles and concepts of the present invention and generally designated by the reference numeral 10 will be described.

As best illustrated in FIGS. 1 through 5, the towable dispenser 10 of the invention is highly stuitable for dispensing elongate flexible materials or members. The elongate flexible materials may include relatively stiff materials from a spool, such as wire, cable, barbed wire, and also may include relatively more flexible materials such as cord, rope, chain, and string. The dispenser is highly suitable for being towed by a towing vehicle, such as an all terrain vehicle with three or four wheels, smaller tractors and utility vehicles, but may be used with larger vehicles. The towable dispenser 10 generally functions as a trailer behind the towing vehicle, and generally includes a frame 12 and a ground engaging mechanism permitting movement of the frame across a ground surface.

The frame 12 of the invention may be removably attachable to the towing vehicle for pulling the frame behind the vehicle. The frame 12 may include a lower portion 14 and an upper portion 15. The lower portion 14 may include a tongue section 16 for removably attaching to the towing vehicle. The tongue section 16 may have a tongue member 18 and a hitch 20 for releasably hitching the tongue member to the towing vehicle. The hitch 20 is mounted on a forward end of the tongue member, and may comprise a pair of spaced ears that extend forwardly from the forward end of the tongue member. The lower portion 14 of the frame 12 may further include an axle section 22 that is attached to the tongue section 16. The axle section 22 may comprise a transverse axle member 24 mounted on a rearward end of the tongue member 18. The axle member 24 has a pair of lateral ends. The axle section 22 may also include a pair of side members 26, 27 that extend between the tongue member 18 and the axle member 24. Each of the side members 26, 27 has a forward end mounted on the tongue member 18 and a rearward end mounted on the axle member 24, and each of the side members may extend rearwardly and outwardly from the tongue member to the axle member.

The upper portion 15 of the frame 12 is generally positioned above the lower portion, and may include at least one upright member that extends upwardly from the lower portion of the frame. In one embodiment of the invention, a pair of upright members 28, 29 extend upwardly from the lower portion 14 of the frame, and may be mounted on the axle member 24 of the lower portion of the frame. The upright members 28, 29 may be substantially vertically oriented. The upper portion 16 of the frame may also include a cross member 30 that extends substantially transversely with respect to the longitudinal extent of the trailer. The cross member 30 may have end portions 32, 33 that are positioned or located at laterally opposite sides of the upper portion 15 of the frame. An opening 34 may be formed in each of the end portions 32, 33 of the cross member 30.

The upper portion 15 of the frame may further include a forward bracing member 36 that extends between the lower portion 14 and the upper portion 15 of the frame. The forward bracing member 36 may have a lower end that is mounted on the tongue member 18 of the lower portion of the frame, and the forward bracing member may slope upwardly and rearwardly from the lower end toward the upper end thereof.

The invention may also include a ground engaging means or mechanism for engaging a ground surface in a manner that supports the frame 12 above the ground surface and permits the frame to move over the ground surface. The ground engaging means may comprise as pair of wheels 38, 39 that may be mounted on the frame, such as on the lower portion 14 with each of the wheels being mounted on one of the lateral ends of the axle member 24 of the axle section 22 of the lower portion of the frame.

A significant feature of the invention is a spool mounting assembly 40 for supporting at least one spool on the frame in a manner that permits the flexible material would on the spool to be payed out from the spool, even when the dispenser 10 is actively being towed by a vehicle. In one highly preferred embodiment of the invention, the spool mounting assembly is adapted to support a pair of spools in a manner such that the flexible material, such as wire, may be simultaneously payed out from both of the spools. This is particularly useful in the installation of wire or barbed wire on a series of fence posts along a fence line so that two strands of barbed wire may be strung along the fence posts simultaneously.

The spool mounting assembly 40 may include a primary support member 42 that may be mounted on the upper portion of the frame, and may extend generally upwardly from the cross member 30 of the upper portion such that an upper end of the primary support member is positioned above the cross member.

Optionally, a tool support 44 may be mounted on the frame 12, and is preferably located on the upper end of the primary support member 42. The tool support 44 is provided for releasably supporting tools thereon, such as hammer, pliers and stretching tools employed in the installation of barbed wire on fence posts, although it will be realized that other tools or items could also be supported on the tool support. The tool support 44 may extend upwardly from the primary support member, and may have at least one aperture 46 that is formed therein for receiving a portion of a tool or other item. The aperture 46 may have an axis that is generally vertically oriented, and in one embodiment of the invention, a plurality of apertures is included on the tool support.

The spool mounting assembly 40 may also include a spool axle 48 for positioning in the bore 6 of a spool supported on the spool mounting assembly. The spool axle 48 may be mounted on the primary support member 42, and has at least one end for inserting into the bore 6. In the embodiment of the spool mounting assembly supporting a pair of spools, each of the opposite ends of the spool axle 48 are available for inserting into the bore of one of the pair of spools, with the primary support member being positioned between the spools.

The spool mounting assembly 40 may also include at least one spool retaining assembly 50 for releasably retaining a spool on the spool axle. When the spool mounting assembly is adapted to support a pair of spools, then a spool retaining assembly 50 may be located at each of the opposite ends of the spool axle 48. The spool retaining assembly 50 may include an inner guide plate 52 that is mounted on the spool axle 48. The inner guide plate 52 may have an aperture 53 extending through the plate for receiving the spool axle therethrough. The spool retaining assembly 50 may also include an outer guide plate 54 that is removably mounted on the spool axle 48 such that a spool may be positioned between the inner 52 and outer 54 guide plates. The outer guide plate 54 may also have an aperture 55 formed therein that receives the spool axle 48 therethrough.

In one embodiment of the invention, the spool retaining assembly 50 includes a support tube 56 for inserting into the bore 6 of a spool. The support tube 56 has a passage extending through the tube 56 for receiving a portion of the spool axle 48 therein. The support tube 56 may have an end that is mounted on the outer guide plate 54 such that the support tube is removed from the spool axle 48 with the outer guide plate, and conversely is remounted on the spool axle 48 with the outer guide plate when the outer guide plate 54 is remounted on the spool axle. The support tube 56 may have a substantially rectangular cross sectional shape for engaging a substantially rectangular bore of a spool, although a more cylindrical tube may be employed.

A significant feature of the spool retaining assembly 50 is the retaining arm 58 which releasably retains an active spool 2 and the outer guide plate 54 on the spool axle 48. The retaining arm 58 may be mounted on the cross member 30 of the upper portion of the frame and on one of the ends of the spool axle 48. The retaining arm 58 may be slidably mounted on the cross member 30 and may be movable between an engaged position and a disengaged position. The engaged position of the retainer arm 58 is characterized by the retaining arm blocking spool movement off of the spool axle, and in one embodiment of the invention this is accomplished by the retaining arm engaging the end of the spool axle 48. The disengaged position of the retainer arm 58 is characterized by the retaining arm permitting, or not blocking, spool movement off of the spool axle, and in one embodiment of the invention this is accomplished by the retaining arm being disengaged or released from the end of the spool axle.

In one embodiment of the invention, the retaining arm 58 comprises a main segment 60, a base segment 62, and a retainer segment 64. The base segment 62 is mounted on the main segment 60 and extends away from the main segment, and may be substantially perpendicularly oriented with respect to the main segment. The base segment 62 may be inserted in the opening 34 in the end 33 of the cross member 30 of the upper portion of the frame. The retaining segment 64 is mounted on main segment 60 at a distance from the base segment 62. The retainer segment 64 may be removably engageable with one of the ends of the spool axle 48 when the retaining arm 58 is in the engaged position. The retainer segment 64 may have a recess 66 formed therein that removably receives the end of the spool axle for capturing and aligning the retainer segment with the end of the spool axle. The retaining arm 58 may thus be slid outwardly from the spool axle and the cross member to remove the retaining arm from those elements so that a spool may be removed from or inserted on the spool axle, and the retaining arm may be slid inwardly to remount the arm on the spool axle and cross member. It will be realized that variations of the mounting may be devised, including a pivoting of the base segment of the retaining arm on the cross member that permits the main segment to be moved toward and away from the end of the spool axle to block spool movement off of the spool axle.

The retaining arm 58 may include means for securing the retaining arm in the engaged position with respect to the spool axle until released. In one embodiment of the invention, the retainer segment 64 of the retaining arm 58 may have a hole 68 that extends through to the recess 66, and that is alignable with a hole 70 in the spool axle 48. A pin 72 may be removably inserted in the hole 68 of the retainer segment and the hole 70 of the spool axle for releasably locking the retaining arm 58 to the spool axle.

Optionally, a loose end retaining member 74 may be included for enabling the wrapping thereabout of a loose end of an elongate flexible member on the active spool 2 mounted on the spool mounting assembly 40. This feature is especially useful when the flexible material on the spool 2 is relatively stiffly flexible, such as wire, that may be wrapped or bent in one or two coils about the member 74 and will stay in the coiled configuration. The loose end retaining member 74 may be mounted on and extend away outwardly from the cross member 30 of the upper portion of the frame. In one embodiment of the invention, the loose end retaining member 74 may have a first portion 76 that extends rearwardly from the cross member and a second portion 77 that extends in a substantially vertical orientation. The second portion 77 of the retaining member 74 may optionally define a channel (not shown) for receiving a portion of the elongate flexible member, which can be useful for capturing the end of flexible materials such as rope or twine that are coiled on the spool 2. The channel may be substantially vertically oriented and extend through the length of the second portion 77 of the retaining member 74.

Another significant optional feature of the invention is an auxiliary spool holding assembly 80 that is provided for holding an inactive spool 4 between uses. The auxiliary spool holding assembly 80 may be mounted on the lower portion of the frame 12, and may be located forward of the axle member 24. In one embodiment of the invention, the auxiliary spool holding assembly 80 includes a holding member 82 that is mounted on the lower portion of the frame, and has opposite end portions which may be positioned generally laterally from the lower portion 14 of the frame. The auxiliary spool holding assembly may also include at least one upright shaft 84 for inserting into the central bore 6 of an inactive spool 4. The upright shaft 84 has a lower end that is mounted on the holding member 82, and a free upper end that is inserted into the bore of the spool. In one embodiment of the invention, a pair of upright shafts 84, 85 are mounted on the holding member 82 for simultaneously holding a pair of inactive spools 4. Each of the upright shafts 84, 85 may be mounted on one of the opposite end portions of the holding member 82.

A further optional feature of the invention comprises an auxiliary hitch 86 that is provided for attaching a trailer to the frame 12 for towing the trailer behind the frame while the dispenser 10 is being towed. The auxiliary hitch 86 may be mounted on the lower portion 14 of the frame, such as, for example, on the axle member 24 at a substantially central location along the axle member. The auxiliary hitch 86 may comprise a drawbar member 88 that extends from the axle member 24, and a receiving hole 90 may be formed in the drawbar member.

In one illustrative use of the invention, a pair of spools of wire may be mounted on the dispenser, a wire from each of the pair of spools is attached to an initial fence post of a series of spaced fence posts that are mounted in and extend upwardly from a ground surface, and the dispenser is towed across the ground surface and away from the initial fence post along the series of fence posts to simultaneously unspool wire from the pair of spools. At least one, or both, of the wires on the spools may be cut to form a loose end, and the loose end may be wrapped about the loose end retaining member mounted on the frame of the dispenser. A trailer may be attached to an auxiliary hitch mounted on the frame of the dispenser and towing the trailer behind the dispenser. One or two spools may be stored on the auxiliary spool holding assembly mounted on the frame between uses of the spool.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A towable dispenser for dispensing an elongate flexible member from a spool while being towed by a towing vehicle, the dispenser comprising:

a frame removably attachable to a vehicle for pulling the frame behind the vehicle;

ground engaging means for engaging a ground surface in a manner supporting the frame above the ground surface and permitting the frame to move over the ground surface; and a spool mounting assembly mounted on the frame for supporting at least one spool on the frame, the spool mounting assembly comprising:

a primary support member mounted on the frame;

a spool axle being mounted on the primary support member for positioning in a bore of the spool supported on the spool mounting assembly, the spool axle having opposite ends;

at least one spool retaining assembly for releasably retaining the spool on the spool axle, the at least one spool retaining assembly being movable between an engaged position in which a retaining arm engages the end of the spool axle such that spool movement in an axial direction off of the spool axle is blocked and a disengaged position in which the retaining arm is disengaged from the end of the spool axle such that spool movement in the axial direction off of the spool axle is permitted without raising the spool axle;

wherein the at least one spool retaining assembly includes retaining arm for releasably retaining the spool on the spool axle, the retaining arm being mounted on the frame and on one of the ends of the spool axle;

wherein the spool retaining assembly includes an inner guide plate mounted on the spool axle and an outer guide plate removably mounted on the spool axle for positioning the at least one spool between the inner and outer guide plates;

wherein the spool retaining assembly includes a support tube for inserting into the bore of the spool, the support tube having a passage therethrough for receiving a portion of the spool axle therethrough, the support tube being removably positioned between the inner and outer guide plates.

2. The dispenser of claim 1 wherein the retaining arm is slidable away from and toward the spool axle.

3. The dispenser of claim 1 wherein the retaining arm comprises:

a main segment;

a base segment mounted on the main segment and extending away from the main segment, the base segment being removably inserted in an opening on the frame; and a retainer segment mounted on the main segment at a distance from the base segment, the retainer segment being removably engageable with one of the ends of the spool axle when the retainer arm is in the engaged position.

4. The dispenser of claim 1 wherein the retaining arm has a recess formed therein for removably receiving the end of the spool axle, the end of the spool axle being positioned in the recess when the retaining arm is in the engaged position and the end of the spool axle being withdrawn out of the recess when the retaining arm is in the disengaged position.

5. The dispenser of claim 1 wherein the support tube is mounted to the outer guide plate and is removable from and remountable to the spool axle with the outer guide plate.

6. The dispenser of claim 1 wherein the frame comprises:

a lower portion of the frame including a tongue section for removably attaching to the towing vehicle and an axle section attached to the tongue section; and an upper portion of the frame being positioned above the lower portion, the upper portion including at least one upright member extending upwardly from the lower portion of the frame and a cross member mounted on the at least one upright member and extending substantially transversely, the cross member having end portions at laterally opposite sides of the upper portion.

7. The dispenser of claim 1 wherein the spool mounting assembly simultaneously supports a pair of spools in a manner permitting elongate material to be simultaneously drawn from each of the spools.

8. The dispenser of claim 1 additionally comprises:

a loose end retaining member for wrapping a loose end of an elongate flexible member from said spool mounted on the spool mounting assembly, the loose end retaining member being mounted on and extending outwardly from the frame;

an auxiliary spool holding assembly for holding an inactive spool between uses, the auxiliary spool holding assembly being mounted on the frame, the auxiliary spool holding assembly comprising a holding member mounted on the frame, and a pair of upright shafts for each inserting into the central bore of the inactive spool, each of the upright shafts having a lower end mounted on the holding member and a free upper end for simultaneously holding a pair of spools;

an auxiliary hitch for attaching a trailer to the frame for towing behind the frame; and a tool support extending from the frame for releasably supporting tools thereon, the tool support having at least one aperture formed therein for receiving a portion of a tool.

9. A towable dispenser for dispensing an elongate flexible member from a spool while being towed by a towing vehicle, the dispenser comprising:

a frame removably attachable to a vehicle for pulling the frame behind the vehicle;

ground engaging means for engaging a ground surface in a manner supporting the frame above the ground surface and permitting the frame to move over the ground surface; and a spool mounting assembly mounted on the frame for supporting at least one spool on the frame, the spool mounting assembly comprising:

a primary support member mounted on the frame;

a spool axle being mounted on the primary support member for positioning in a bore of the spool supported on the spool mounting assembly, the spool axle having opposite ends;

at least one spool retaining assembly for releasably retaining the spool on the spool axle;

wherein the retaining arm has a hole extending therein that is alignable with a hole in the spool axle when the retaining arm is in the engaged position, and a pin removably inserted into the hole of the retaining arm and the hole of the spool axle for releasably locking the retaining arm in the engaged position.

10. A towable dispenser for dispensing an elongate flexible member from a spool while being towed by a towing vehicle, the dispenser comprising:

a frame removably attachable to a vehicle for pulling the frame behind the vehicle;

ground engaging means for engaging a ground surface in a manner supporting the frame above the ground surface and permitting the frame to move over the ground surface; and a spool mounting assembly mounted on the frame for supporting at least one spool on the frame, the spool mounting assembly comprising:

a primary support member mounted on the frame;

a spool axle being mounted on the primary support member for positioning in a bore of the spool supported on the spool mounting assembly, the spool axle having opposite ends;

at least one spool retaining assembly for releasably retaining the spool on the spool axle;

a loose end retaining member for wrapping a loose end of an elongate flexible member from the spool mounted on the spool mounting assembly, the loose end retaining member being mounted on and extending outwardly from the frame.

11. A towable dispenser for dispensing an elongate flexible member from a spool while being towed by a towing vehicle, the dispenser comprising:

a frame removably attachable to a vehicle for pulling the frame behind the vehicle;

ground engaging means for engaging a ground surface in a manner supporting the frame above the ground surface and permitting the frame to move over the ground surface; and a spool mounting assembly mounted on the frame for supporting at least one spool on the frame, the spool mounting assembly comprising:

a primary support member mounted on the frame;

a spool axle being mounted on the primary support member for positioning in a bore of the spool supported on the spool mounting assembly, the spool axle having opposite ends;

at least one spool retaining assembly for releasably retaining the spool on the spool axle;

an auxiliary spool holding assembly for holding an inactive spool between uses, the auxiliary spool holding assembly being mounted on the frame, the auxiliary spool holding assembly comprising a holding member mounted on the frame, and at least one upright shaft for inserting into the central bore of the inactive spool, the at least one upright shaft having a lower end mounted on the holding member and a free upper end.

12. The dispenser of claim 11 wherein a pair of the upright shafts are mounted on the holding member for simultaneously holding a pair of spools.

13. A towable dispenser for dispensing an elongate flexible member from a spool while being towed by a towing vehicle, the dispenser comprising:

a frame removably attachable to a vehicle for pulling the frame behind the vehicle;

ground engaging means for engaging a ground surface in a manner supporting the frame above the ground surface and permitting the frame to move over the ground surface; and a spool mounting assembly mounted on the frame for supporting at least one spool on the frame, the spool mounting assembly comprising:

a primary support member mounted on the frame;

a spool axle being mounted on the primary support member for positioning in a bore of the spool supported on the spool mounting assembly, the spool axle having opposite ends;

at least one spool retaining assembly for releasably retaining & the spool on the spool axle; and an auxiliary hitch for attaching a trailer to the frame for towing behind the frame.

14. A towable dispenser for dispensing an elongate flexible member from a spool while being towed by a towing vehicle, the dispenser comprising:

a frame removably attachable to a vehicle for pulling the frame behind the vehicle;

ground engaging means for engaging a ground surface in a manner supporting the frame above the ground surface and permitting the frame to move over the ground surface; and a spool mounting assembly mounted on the frame for supporting at least one spool on the frame, the spool mounting assembly comprising:

a primary support member mounted on the frame;

a spool axle being mounted on the primary support member for positioning in a bore of the spool supported on the spool mounting assembly, the spool axle having opposite ends;

at least one spool retaining assembly for releasably retaining the spool on the spool axle;

a tool support extending from the frame for releasably supporting tools thereon, the tool support having at least one aperture formed therein for receiving a portion of a tool.

15. A method of dispensing wire for constructing a fence, comprising:

providing a towable dispenser including a frame removably attachable to a vehicle for pulling the frame behind the vehicle; ground engaging means for engaging a ground surface in a manner supporting the frame above the ground surface and permitting the frame to move over the ground surface; and a spool mounting assembly mounted on the frame for supporting at least one spool on the frame, the spool mounting assembly comprising a primary support member mounted on the frame, a spool axle being mounted on the primary support member for positioning in a bore of a spool supported on the spool mounting assembly, the spool axle member having opposite ends, and at least one spool retaining assembly for releasably retaining the spool on the spool axle;

mounting a pair of spools of wire on the dispenser;

attaching a wire from each of the pair of spools to an initial fence post of a series of spaced fence posts mounted in and extending upwardly from a ground surface; and towing the dispenser across the ground surface and away from the initial fence post along the series of fence posts to simultaneously unspool wire from the pair of spools;

cutting at least one of the wires on the spools to form a loose end and wrapping the loose end about a loose end retaining member mounted on the frame of the dispenser;

attaching a trailer to an auxiliary hitch mounted on the frame of the dispenser and towing the trailer behind the dispenser; and storing an inactive spool on an auxiliary spool holding assembly mounted on the frame between uses of the spool.

* * * * *